US006179983B1

(12) United States Patent
Reid et al.

(10) Patent No.: US 6,179,983 B1
(45) **Date of Patent: *Jan. 30, 2001**

(54) METHOD AND APPARATUS FOR TREATING SURFACE INCLUDING VIRTUAL ANODE

(75) Inventors: Jonathan David Reid, Sherwood; Steve Taatjes, West Linn, both of OR (US)

(73) Assignee: Novellus Systems, Inc., San Jose, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/969,267

(22) Filed: Nov. 13, 1997

(51) Int. Cl.[7] ..... C25D 5/00; C25D 17/08

(52) U.S. Cl. ..... 205/96; 205/118; 205/157; 204/227; 204/228.1; 204/230.2; 204/230.3; 204/242; 204/DIG. 7

(58) Field of Search ..... 205/96, 118, 157; 204/242, 227, 228, DIG. 7, 228.1, 230.2, 230.3

(56) References Cited

U.S. PATENT DOCUMENTS

| | | | |
|---|---|---|---|
| 3,962,047 | 6/1976 | Wagner | 204/15 |
| 4,137,867 | 2/1979 | Aigo | 118/627 |
| 4,170,959 | 10/1979 | Aigo | 118/627 |
| 4,246,088 | 1/1981 | Murphy et al. | 204/181 R |
| 4,259,166 | 3/1981 | Whitehurst | 204/279 |
| 4,280,882 | 7/1981 | Hovey | 204/15 |
| 4,304,641 | 12/1981 | Grandia et al. | 204/23 |
| 4,339,297 | 7/1982 | Aigo | 156/345 |
| 4,339,319 | 7/1982 | Aigo | 204/224 |
| 4,341,613 | 7/1982 | Prusak et al. | 204/281 |
| 4,466,864 | 8/1984 | Bacon et al. | 204/15 |
| 4,469,566 | 9/1984 | Wray | 204/23 |
| 4,534,832 | 8/1985 | Doiron, Jr. | 204/15 |
| 4,565,607 | 1/1986 | Hanak et al. | 204/38.1 |
| 4,597,836 | 7/1986 | Schaer et al. | 204/4 |
| 4,696,729 | 9/1987 | Santini | 204/224 R |
| 4,828,654 | 5/1989 | Reed | 204/23 |
| 4,861,452 | 8/1989 | Stierman et al. | 204/297 W |
| 4,879,007 | 11/1989 | Wong | 204/15 |
| 4,906,346 | 3/1990 | Hadersbeck et al. | 204/238 |
| 4,931,149 | 6/1990 | Stierman et al. | 204/15 |
| 5,000,827 | 3/1991 | Schuster et al. | 204/15 |
| 5,024,746 | 6/1991 | Stierman et al. | 204/297 W |
| 5,078,852 | 1/1992 | Yee et al. | 204/297 R |
| 5,096,550 | 3/1992 | Mayer et al. | 204/129.1 |
| 5,135,636 | 8/1992 | Yee et al. | 205/96 |
| 5,222,310 | 6/1993 | Thompson et al. | 34/202 |
| 5,227,041 | 7/1993 | Brogden et al. | 204/297 R |
| 5,332,487 | 7/1994 | Young, Jr. et al. | 205/80 |
| 5,372,699 | 12/1994 | Rischke et al. | 205/129 |
| 5,377,708 | 1/1995 | Bergman et al. | 134/105 |
| 5,391,285 | 2/1995 | Lytle et al. | 205/123 |
| 5,405,518 | 4/1995 | Hsieh et al. | 204/297 R |
| 5,421,987 | 6/1995 | Tzanavaras et al. | 205/133 |
| 5,429,733 | 7/1995 | Ishida | 204/224 R |
| 5,437,777 | 8/1995 | Kishi | 204/224 R |

(List continued on next page.)

* cited by examiner

*Primary Examiner*—Arun S. Phasge
(74) *Attorney, Agent, or Firm*—Skjerven Morrill MacPherson LLP; David E. Steuber

(57) ABSTRACT

An apparatus for depositing an electrical conductive layer on the surface of a wafer includes a virtual anode located between the actual anode and the wafer. The virtual anode modifies the electric current flux and plating solution flow between the actual anode and the wafer to thereby modify the thickness profile of the deposited electrically conductive layer on the wafer. The virtual anode can have openings through which the electrical current flux passes. By selectively varying the radius, length, or both, of the openings, any desired thickness profile of the deposited electrically conductive layer on the wafer can be readily obtained.

34 Claims, 5 Drawing Sheets

U.S. PATENT DOCUMENTS

| | | | |
|---|---|---|---|
| 5,441,629 | 8/1995 | Kosaki | 205/148 |
| 5,443,707 | 8/1995 | Mori | 204/242 |
| 5,447,615 | 9/1995 | Ishida | 204/224 R |
| 5,462,649 | 10/1995 | Keeney et al. | 205/93 |
| 5,472,592 | 12/1995 | Lowery | 205/137 |
| 5,498,325 | 3/1996 | Nishimura et al. | 205/96 |
| 5,522,975 | 6/1996 | Andricacos et al. | 204/297 R |
| 5,597,460 | 1/1997 | Reynolds | 204/212 |
| 5,620,581 | 4/1997 | Ang | 205/96 |
| 5,670,034 | 9/1997 | Lowery | 205/143 |
| 5,725,745 | 3/1998 | Ikegaya | 204/284 |
| 5,744,019 | 4/1998 | Ang | 205/96 |
| 5,750,014 | 5/1998 | Stadler et al. | 204/224 R |
| 5,776,327 * | 7/1998 | Botts et al. | 205/96 |
| 5,788,829 * | 8/1998 | Joshi et al. | 205/96 |
| 5,804,052 | 9/1998 | Schneider | 205/96 |
| 5,843,296 | 12/1998 | Greenspan | 205/68 |
| 5,855,850 | 1/1999 | Sittler | 422/98 |

METHOD AND APPARATUS FOR TREATING SURFACE INCLUDING VIRTUAL ANODE

CROSS REFERENCE TO RELATED APPLICATION

This application is related to Patton et al., co-filed application Ser. No. 08/969,984; Contolini et al., co-filed application Ser. No. 08/970,120; and Reid et al., co-filed application Ser. No. 08/969,196, now abandoned all filed Nov. 13, 1997, all of which are incorporated herein by reference in their entirety.

FIELD OF INVENTION

The present invention relates generally to an apparatus for treating the surface of a substrate and more particularly to an apparatus for electroplating a layer on a semiconductor wafer.

BACKGROUND OF THE INVENTION

The manufacture of semiconductor devices often requires the formation of electrical conductors on semiconductor wafers. For example, electrically conductive leads on the wafer are often formed by electroplating (depositing) an electrically conductive layer such as copper on the wafer and into patterned trenches.

Electroplating involves making electrical contact with the wafer surface upon which the electrically conductive layer is to be deposited (hereinafter the "wafer plating surface"). Current is then passed through a plating solution (i.e. a solution containing ions of the element being deposited, for example a solution containing $Cu^{++}$) between an anode and the wafer plating surface (the wafer plating surface being the cathode). This causes an electrochemical reaction on the wafer plating surface which results in the deposition of the electrically conductive layer.

To minimize variations in characteristics of the devices formed on the wafer, it is important that the electrically conductive layer be deposited uniformly (have a uniform thickness) over the wafer plating surface. However, conventional electroplating processes produce nonuniformity in the deposited electrically conductive layer due to the "edge effect" described in Schuster et al., U.S. Pat. No. 5,000,827, herein incorporated by reference in its entirety. The edge effect is the tendency of the deposited electrically conductive layer to be thicker near the wafer edge than at the wafer center.

To offset the edge effect, Schuster et al. teaches nonlaminar flow of the plating solution in the region near the edge of the wafer, i.e., teaches adjusting the flow characteristics of the plating solution to reduce the thickness of the deposited electrically conductive layer near the wafer edge. However, the range over which the flow characteristics can be thus adjusted is limited and difficult to control. Therefore, it is desirable to have a method of offsetting the edge effect which does not rely on adjustment of the flow characteristics of the plating solution.

Another conventional method of offsetting the edge effect is to make use of "thieves" adjacent the wafer. By passing electrical current between the thieves and the anode during the electroplating process, electrically conductive material is deposited on the thieves which otherwise would have been deposited on the wafer plating surface near the wafer edge where the thieves are located. This improves the uniformity of the deposited electrically conductive layer on the wafer plating surface. However, since electrically conductive material is deposited on the thieves, the thieves must be removed periodically and cleaned, thus adding to the maintenance cost and downtime of the apparatus. Further, additional power supplies must be provided to power the thieves, adding to the capital cost of the apparatus. Accordingly, it is desirable to avoid the use of thieves.

SUMMARY OF THE INVENTION

In accordance with the present invention, there is provided a "virtual" anode between the actual anode (hereinafter "the anode") and the wafer plating surface. This virtual anode, made of an electrically insulating material, acts to modify the electric current flux and the plating solution flow between the anode and the wafer plating surface in a manner which can be controlled by the shape and location of this virtual anode. Since the thickness of the deposited electrically conductive layer at any particular region of the wafer plating surface is determined by the electric current flux to the particular region, this virtual anode permits any desired thickness profile of the deposited electrically conductive layer.

In one embodiment, the virtual anode takes the form of a member positioned between the anode and the wafer plating surface, this member having at least one opening therein through which plating solution flows. This virtual anode has the effect of regulating both the electric current flux and the plating solution flow between the anode and the wafer plating surface, depending upon the shape and location of the virtual anode. The virtual anode also has the effect of "decoupling" the electric current flux from the plating solution flow so that the two variables may be controlled independent of each other.

In one embodiment of the invention, the virtual anode has a plurality of openings therein, at least one of which is of a different cross-sectional area than at least one of the others, or is of a different length, or both. In general, a change in the cross-sectional area of an opening produces a greater change in the plating solution flow than in the electric current flux through the opening. Thus, by using openings of different cross-sectional area, the plating solution flow can be decoupled (independently varied) from the electric current flux through the openings. In contrast, a change in the length of an opening produces a linear change in both the plating solution flow and the electric current flux through the opening.

In one particular embodiment the openings are cylindrical. In this embodiment, the electric current through any particular opening is inversely proportional to the length of the opening and is directly proportional to the square of the radius of the opening. The plating solution flow through any particular opening is also inversely proportional to the length of the opening. However, in contrast to the electric current flux which is directly proportional to the square of the radius of the opening, the plating solution flow through any particular opening is directly proportional to the cube of the radius of the opening. Similar relations exist for openings of other shapes. Thus, by combining various openings of variable length and variable cross-sectional area, electric current flux and plating solution flow to the wafer can be controlled and, if desired, decoupled from one another. This allows any desired thickness profile of the deposited electrically conductive layer on the wafer plating surface to be obtained.

In a first alternate embodiment, the virtual anode is in the form of an annulus attached to an anode cup of the anode. This virtual anode acts as a shield to limit the amount of electric current flux at the edge region of the wafer by forcing the electric current flux to pass around the virtual anode, thereby reducing the thickness of the deposited electrically conductive layer on the wafer edge region.

In the second alternative embodiment, intended for use when it is desired to have a relatively thick deposit on the edge region of the wafer and a relatively thin deposit on the center region, the virtual anode comprises a disk overlying the center of the anode. This virtual anode effectively shields the center region of the wafer from the electric current flux thereby reducing the thickness of the deposited electrically conductive layer on the center region.

DESCRIPTION OF THE PREFERRED EMBODIMENT

Figure 1:
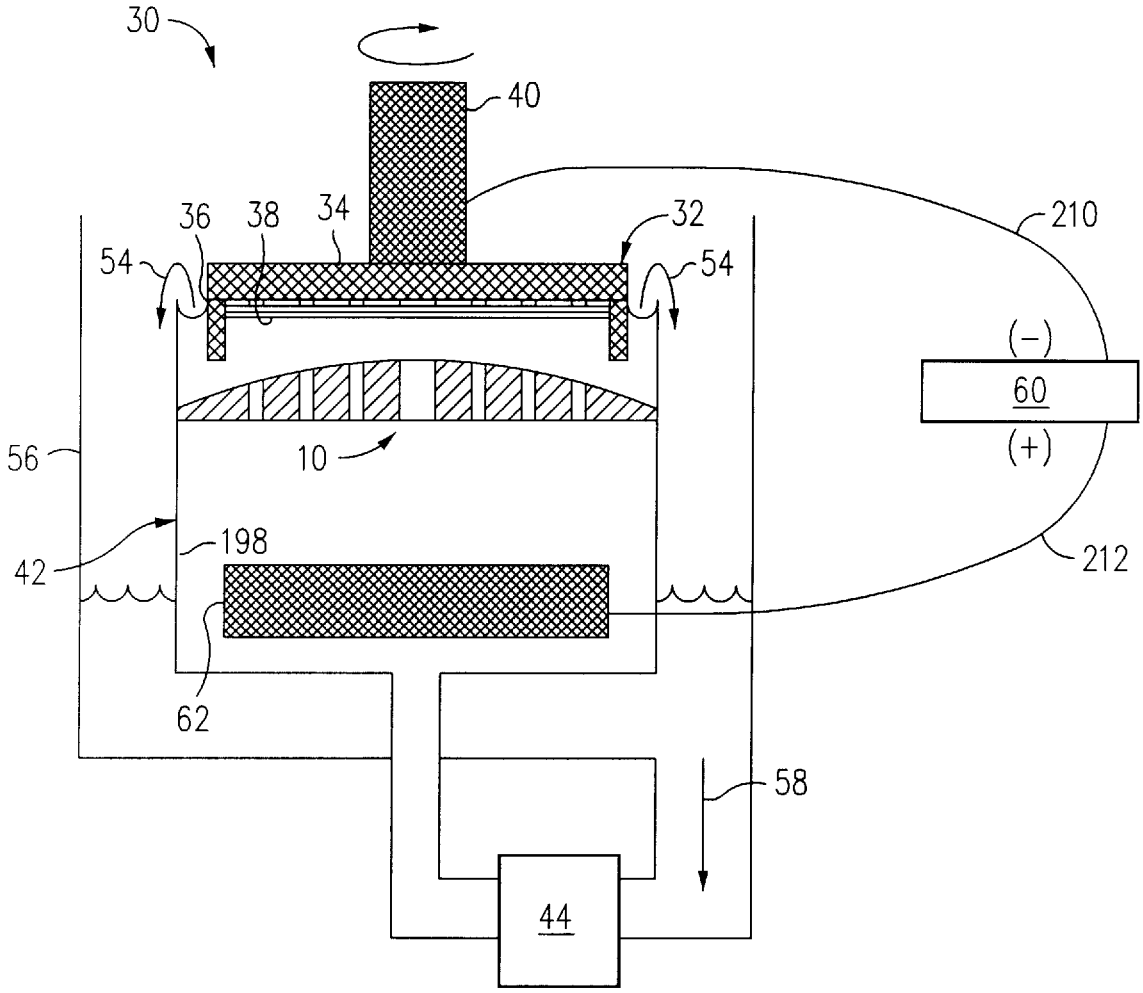
FIG. 1 is a diagrammatic view of an electroplating apparatus having a virtual anode mounted therein in accordance with the present invention.

FIG. 1 is a diagrammatic view of an electroplating apparatus in accordance with the present invention. Apparatus 30 includes a clamshell 32 mounted on a rotatable spindle 40 which provides rotation of clamshell 32. Clamshell 32 comprises a cone 34 and a cup 36. A clamshell of a type for use as clamshell 32 is described in detail in Patton et al., co-filed application Ser. No. 08/969,984, identified above.

During the electroplating process, a wafer 38 preferably having an electrically conductive seed layer thereon is mounted in cup 36. Clamshell 32 and hence wafer 38 are then placed in a plating bath 42 containing a plating solution. The plating solution is continually provided to plating bath 42 by a pump 44. Generally, the plating solution flows upwards through openings in anode 62 and around anode 62 (to be explained further in connection with FIG. 2) toward wafer 38.

Disposed between anode 62 and wafer 38 is one embodiment of a virtual anode 10 in accordance with this invention. The periphery of virtual anode 10 is secured to a cylindrical wall 198 of plating bath 42 and is positioned at a distance from wafer 38 which is determined by the desired thickness profile of the electrically conductive layer to be deposited on wafer 38. The general rule is that the closer virtual anode 10 is to wafer 38, the greater the influence virtual anode 10 has on the resulting thickness profile of the electrically conductive layer to be deposited on wafer 38, as will be described in more detail below. Since virtual anode 10 is secured (sealed) to wall section 198 of plating bath 42, the plating solution flows through virtual anode 10. After flowing through virtual anode 10, the plating solution then overflows plating bath 42 to an overflow reservoir 56, as indicated by arrows 54. The plating solution is filtered (not shown) and returned to pump 44 as indicated by arrow 58, completing the recirculation of the plating solution.

A DC power supply 60 has a negative output lead 210 electrically connected to wafer 38 through one or more slip rings, brushes and contacts (not shown). The positive output lead 212 of power supply 60 is electrically connected to anode 62 located in plating bath 42. During use, power supply 60 biases wafer 38 to have a negative potential relative to anode 62, causing an electrical current to flow from anode 62 through virtual anode 10 to wafer 38. As used herein, electrical current flows in the same direction as the net positive ion flux and opposite the net electron flux, wherein electric current is defined as the amount of charge flowing through an area per unit time. This also causes an electric current flux from anode 62 through virtual anode 10 to wafer 38, wherein electric current flux is defined as the number of lines of forces (field lines) through an area. This causes an electrochemical reaction (e.g. $Cu^{++}+2e^{-}=Cu$) on wafer 38 which results in the deposition of the electrically conductive layer (e.g. copper) on wafer 38. The ion concentration of the plating solution is replenished during the plating cycle by dissolving a metal in anode 62 which includes, for example, a metallic compound (e.g. $Cu=Cu^{++}+2e^{-}$), as described in detail below.

Figure 2:
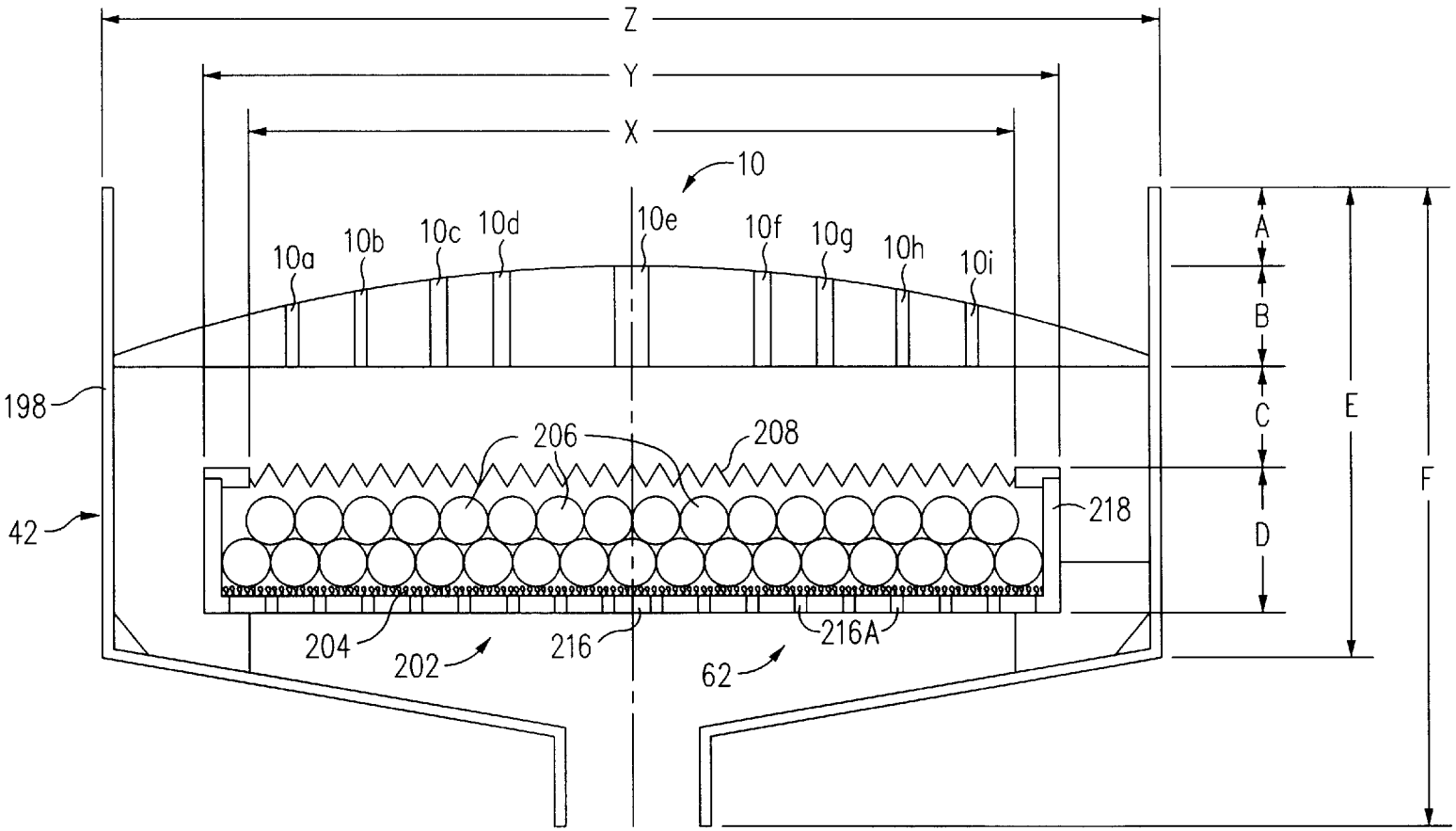
FIG. 2 is a cross-sectional view of an electroplating apparatus and one embodiment of a virtual anode in accordance with the present invention.

FIG. 2 is a cross-sectional view of anode 62 and virtual anode 10 in plating bath 42, plating bath 42 including cylindrical wall section 198. Anode 62 comprises an anode cup 202, ion source material 206, and a membrane 208. Anode cup 202 is typically an electrically insulating material such a polyvinyl chloride (PVC). Anode cup 202 comprises a disk shaped base section 216 having a plurality of spaced openings 216A therein through which plating solution flows. Anode cup 202 further comprises a cylindrical wall section 218 integrally attached at one end (the bottom) to base section 216.

An electrical contact and filter sheet is typically provided, as shown in detail in the application Reid et al., Ser. No. 08/969,196 identified above, now abandoned. The contact 204 may be in the form of an electrically conductive, relatively inert mesh such as titanium mesh, and rests on the filter sheet which rests on base section 216 of anode cup 202. Resting on and electrically connected with contact 204 is ion source material 206, for example copper. During use, ion source material 206 electrochemically dissolves (e.g. $Cu=Cu^{2+}+2e^{-}$), replenishing the ion concentration of the plating solution.

Ion source material 206 is contained in an enclosure formed by anode cup 202 and membrane 208. More particularly, membrane 208 forms a seal at its outer circumference with a second end (the top) of wall section 218 of anode cup 202. Although allowing electrical current to flow through, membrane 208 has a high electrical resistance which produces a voltage drop across membrane 208 from the lower surface to the upper surface. This advantageously minimizes variations in the electric field from ion source material 206 as it dissolves and changes shapes.

In addition to having a porosity sufficient to allow electrical current to flow through, membrane 208 also has a porosity sufficient to allow plating solution to flow through membrane 208, i.e. has a porosity sufficient to allow liquid to pass through membrane 208. However, to prevent particulates generated by ion source material 206 from passing through membrane 208 and contaminating the wafer, the porosity of membrane 208 prevents large size particles from passing through membrane 208. Generally it is desirable to prevent particles greater in size than one micron (1.0 $\mu$m) from passing through membrane 208.

Virtual anode 10 extends between and is attached on its entire outer periphery to wall 198 of plating bath 42. In the embodiment illustrated in FIG. 2, virtual anode 10 has a curved cross-section, being thinnest at the edge (periphery) and increasing in thickness toward the center. Virtual anode 10 is provided with a plurality of openings 10*a*–10*i* extending through virtual anode 10 from the bottom side (the side facing anode cup 202) to the upper side. Openings 10*a*–10*i* each have a different length, opening 10*e* in the center of virtual anode 10 being the longest and openings 10*d*–10*a* and openings 10*f*–10*i* being of gradually reduced length as illustrated. Further, opening 10*e* in the center of virtual anode 10 has the largest radius, while openings 10*c*, 10*d* and openings 10*f*, 10*g* have a smaller radius, and openings 10*a*, 10*b* and openings 10*h*, 10*i* have an even smaller radius. In the embodiment of FIG. 2, openings 10*d*, 10*c* and openings 10*f* and 10*g* have equal radii, while openings 10*b*, 10*a* and openings 10*h*, 10*i* have radii which are smaller than the remainder of the openings but are equal to each other. However, this is a matter of choice, the important point being that the openings control both the electric current flux and the plating solution flow through virtual anode 10.

Representative dimensions for a typical plating apparatus in accordance with FIG. 2 are given in Table 1.

TABLE 1

| Characteristic | Dimension |
|---|---|
| X | 8.0 In. |
| Y | 9.0 In. |
| Z | 10.0 In. |
| A | 1.0 In. |
| B | 1.0 In. |
| C | 1.0 In. |
| D | 1.5 In. |
| E | 4.89 In. |
| F | 7.05 In. |

Figure 3:
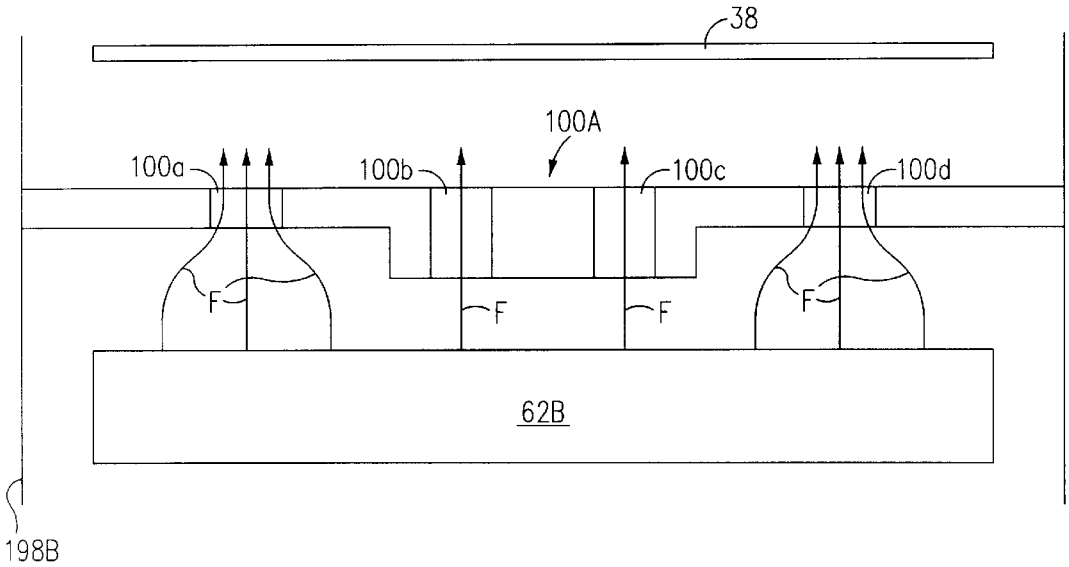
FIG. 3 is a diagrammatic representation of the effect of a virtual anode having variable length openings on the electric current flux between the anode and the wafer plating surface in accordance with the present invention.

FIG. 3 diagrammatically illustrates one example of the action of cylindrical openings in a virtual anode in modifying the electric current flux and the plating solution flow through the virtual anode. An electric current flux represented by flux lines F is established between anode 62B and wafer 38, and this electric current flux is uniform in the immediate vicinity of anode 62B. However, the presence of virtual anode 100A between anode 62B and wafer 38 modifies both the electric current flux and the plating solution flow. The effect on the electric current flux of the length of the openings in the virtual anode may be likened to a variable resistance, the longer the path through the virtual anode, the greater the electrical "resistance" to the electric current flux. More particularly, the change in electric current flux through any particular opening is inversely proportional to the length of the opening. This is illustrated in FIG. 3 where openings 100*b* and 100*c* are longer than openings 100*a* and 100*d* and thus present more electrical resistance than do openings 100*a*, 100*d*. Hence, more electric current flux (i.e. a greater percentage of the total electric current flux to wafer 38) and more flux lines F pass through the shorter openings 100*a* and 100*d* than pass through the longer openings 100*b* and 100*c* resulting in a greater thickness of the deposited electrically conductive layer on the wafer edge region. (A greater electric current flux to a particular wafer region results in a greater thickness of the deposited electrically conductive layer at that region.)

The plating solution flow through any particular opening is also inversely proportional to the length of the opening. Thus, although openings 100*a*–100*d* of FIG. 3 have equal radii, the greater length of openings 100*b*, 100*c* will reduce the plating solution flow therethrough compared to openings 100*a* and 100*d*.

For purposes of illustration assume the case where openings 100*b* and 100*c* are twice the length of openings 100*a* and 100*d*. Accordingly, there will be twice the electric current flux and twice the plating solution flow through openings 100*a* and 100*d* compared to openings 100*b* and 100*c*. Thus, a change in the length of an opening causes a linear change in both the electric current flux and plating solution flow through the opening. Accordingly a change in length of an opening does not decouple the electric current flux from the plating solution flow.

Figure 4:
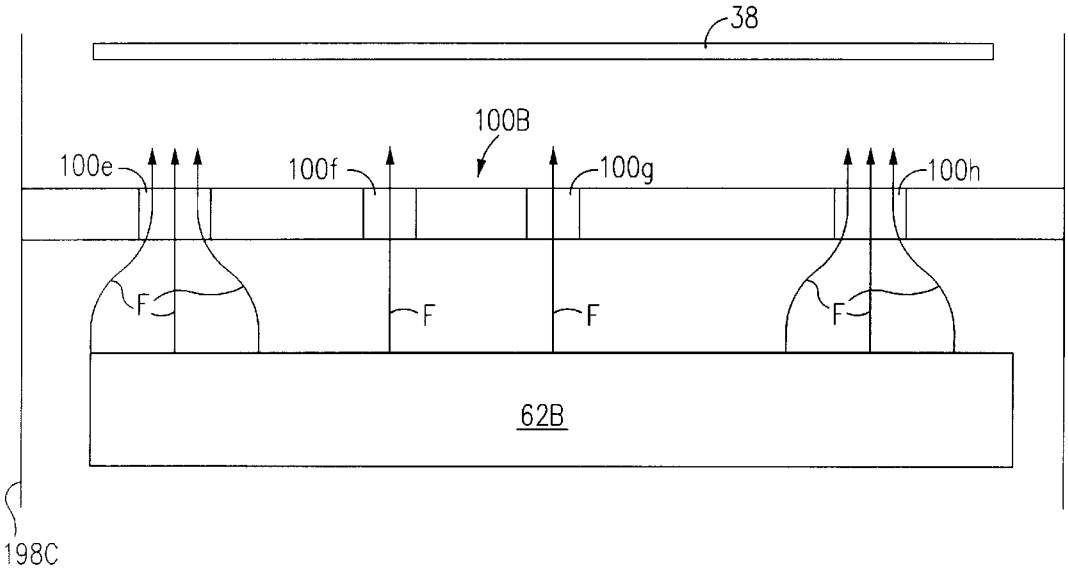
FIG. 4 is a diagrammatic representation of the effect of a virtual anode having variable radius openings on the electric current flux between the anode and the wafer plating surface in accordance with the present invention.

FIG. 4 diagrammatically illustrates another example of the action of cylindrical openings in a virtual anode in modifying the electric current flux and plating solution flow through the virtual anode and, more particularly, in decoupling the electric current flux from the plating solution flow. In FIG. 4, all openings 100*e*–100*h* have equal length, but openings 100*e* and 100*h* have a greater radius than openings 100*f* and 100*g*. The electric current flux through any particular opening is directly proportional to the square of the radius of the opening. However, the plating solution flow through any particular opening is directly proportional to the cube of the radius of the opening. Thus, plating solution flow will be significantly greater through openings 100*e* and 100*h* compared to openings 100*f* and 100*g*. The electric current flux, represented by flux lines F, will also be greater through openings 100*e* and 100*h* compared to openings 100*f* and 100*g*, although to a lesser extent than plating solution flow. Thus, the percentage of the total plating solution flow to wafer 38 is significantly greater through openings 100*e* and 100*h* compared to the smaller radius openings 100*f* and 100*g* while the percentage of the total electric current flux to wafer 38 is only somewhat greater through openings 100*e* and 100*h* compared to the smaller radius openings 100*f* and 100*g*.

Since a change in the radius of an opening produces a non-linear change in the electric current flux compared to the plating solution flow through the opening, to decouple the electric current flux from the plating solution flow, the radii of the openings are adjusted. In one embodiment, by using a plurality of small radius openings in contrast to a lesser number of larger radius openings, the total cross-sectional areas of the small radius openings and the larger radius openings being the same, the plating solution flow is restricted while the electric current flux remains essentially unchanged through the openings.

Figure 5:
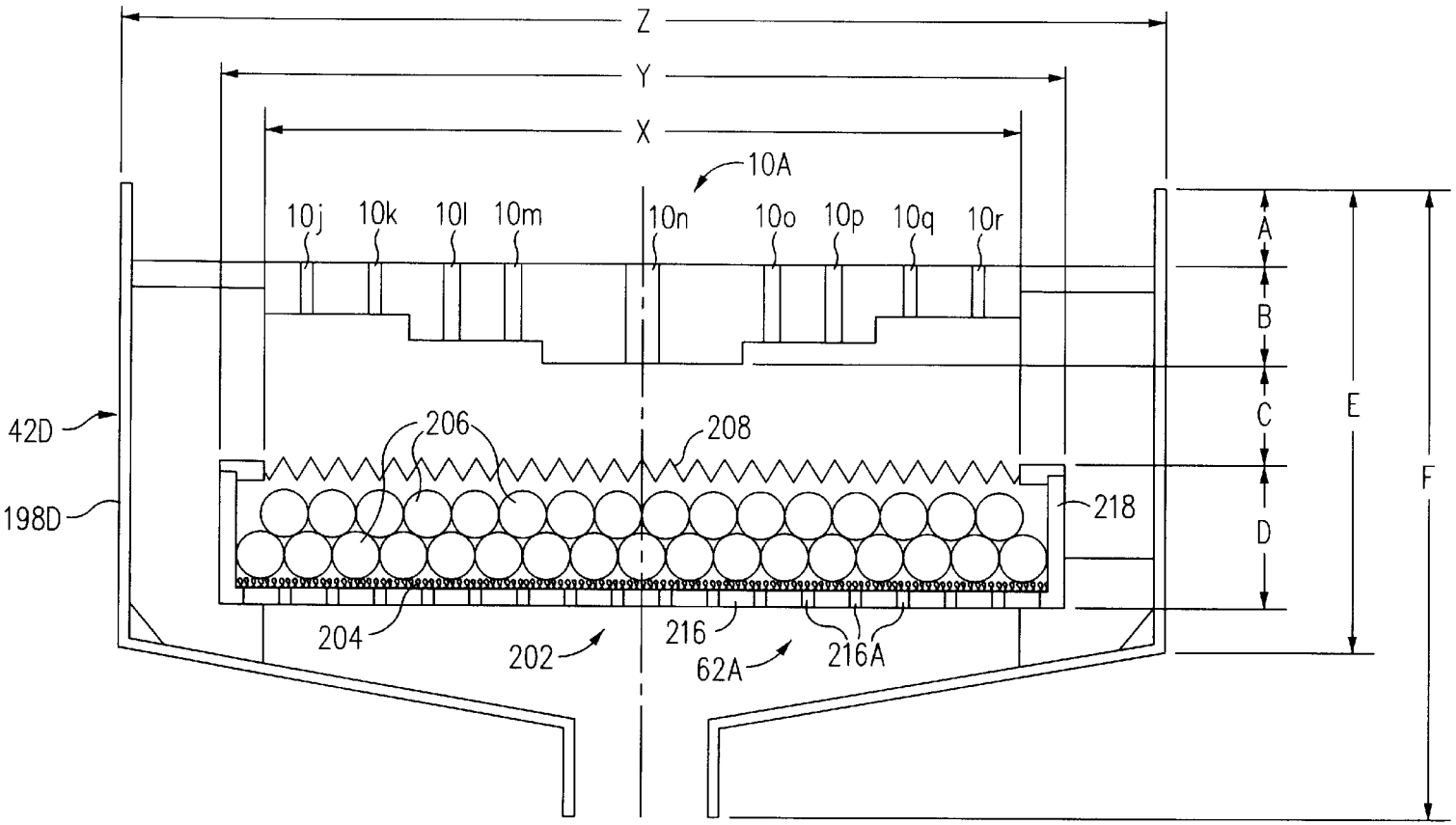
FIG. 5 is a cross-sectional view of an alternate embodiment of the virtual anode in accordance with the present invention.

FIG. 5 illustrates an alternate embodiment of a virtual anode involving a stepped cross-section rather than the contoured cross-section of the virtual anode of FIG. 2. Virtual anode 10A has a plurality of openings therein 10*j*–10*r* which are generally similar in configuration and location to openings 10*a*–10*i* in the embodiment of FIG. 2. The only difference between the two embodiments is that, for ease of fabrication, virtual anode 10A is of a stepped construction. The operation of the embodiment of FIG. 5 is similar to that described above for FIG. 2, with the variable lengths and variable radius of openings 10*j*–10*r* controlling the electric current flux and the plating solution flow through virtual anode 10A. The dimensions given in Table I for the embodiment of FIG. 2 generally apply to the embodiment of FIG. 5.

Figure 7:
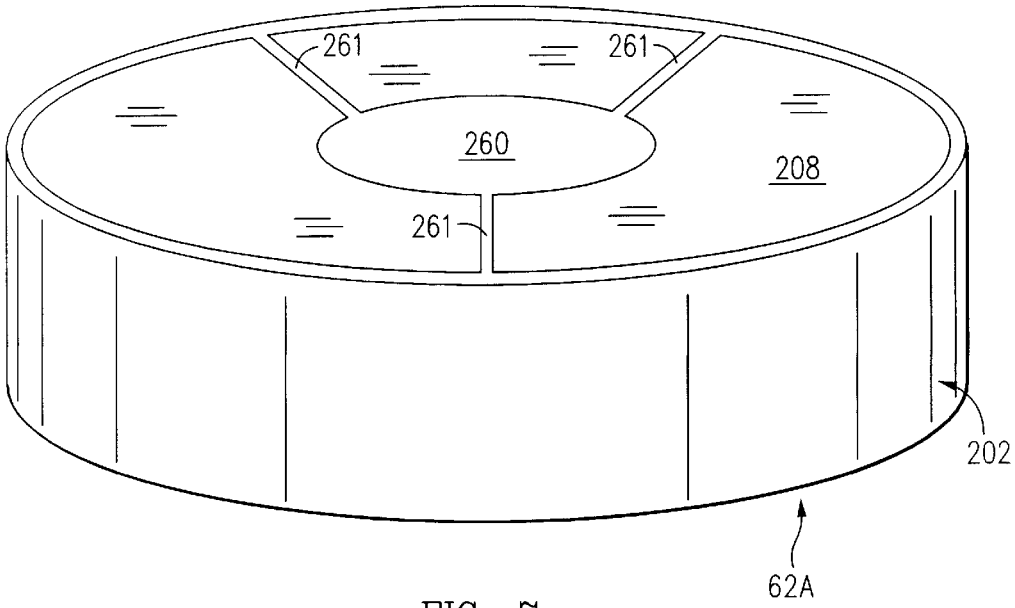
FIG. 7 is an isometric view of a further embodiment of a virtual anode which acts to shield the center region of the wafer in accordance with the present invention.

Although the embodiment of FIG. 2 and FIG. 5 both illustrate virtual anodes which restrict the plating solution flow to the wafer edge region compared to the center region while providing a relatively uniform electric current flux to the wafer plating surface, it will be apparent that other embodiments of the invention are possible, including configurations which reduce the electric current flux and plating solution flow to the central region of the wafer compared to the edge region, as shown in FIG. 7.

Figure 6:
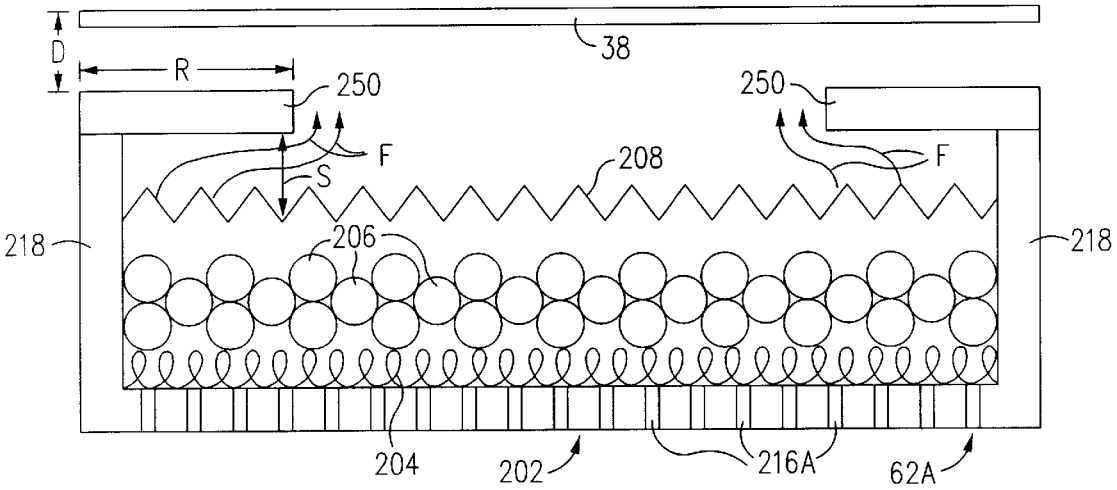
FIG. 6 is a cross-sectional view illustrating another embodiment of a virtual anode which acts to shield the edge region of the wafer in accordance with the present invention.

FIG. 6 diagrammatically illustrates another alternate embodiment of the invention in which the virtual anode 250 takes the form of an annulus extending inwardly from the top of wall section 218 of anode cup 202. Virtual anode 250 is a suitable electrical insulating material and acts as a shield for the flux lines F emanating through membrane 208 reducing the thickness of the deposited electrically conductive layer on the edge region of wafer 38. Important dimensions are illustrated in FIG. 6 and include the distance D between virtual anode 250 and wafer 38, the distance R which virtual anode 250 extends inward from anode cup 202, and the distance S representing the spacing between virtual anode 250 and membrane 208. Generally, the greater distance R is, and the smaller distances D, S are, the greater the shielding of the wafer edge region by virtual anode 250. Since each of these dimensions affects the flux lines F reaching wafer 38 and hence the thickness profile of the deposited electrically conductive layer, the thickness profile can be readily adjusted to suit the particular application by adjusting these dimensions.

FIG. 7 illustrates a further embodiment of the invention which is adapted for use where it is desired to have less deposited on the center region of the wafer. In that situation, virtual anode 260 takes the form of a disk of a suitable insulating material which overlies the center of anode 62A. Virtual anode 260 is suspended by rib-like members 261 which may be attached to anode cup 202 and overlie membrane 208. Virtual anode 260 effectively blocks the electric current flux and plating solution flow to the center region of the wafer, thereby reducing the thickness of the deposited electrically conductive layer at the center region of the wafer. In an alternative embodiment (not shown), a jet or tube is passed through the center of anode 62A and through the center of virtual anode 260 to direct plating solution at the center region of the wafer as further described in Reid et al., application Ser. No. 08/969,196, cited above, now abandoned.

Having thus described the preferred embodiments, persons skilled in the art will recognize that changes may be made in form and detail without departing from the spirit and scope of the invention. Thus the invention is limited only by the following claims.

We claim:

1. An apparatus for treating the surface of a substrate comprising:

a clamshell for holding said substrate;

a plating bath having a wall section;

a virtual anode having a periphery secured to said wall section, said virtual anode having at least one opening therein; and an anode, said virtual anode being located between said clamshell and said anode.

2. The apparatus of claim 1 wherein said virtual anode has a plurality of openings therein.

3. The apparatus of claim 2 wherein at least one of said plurality of openings has a different length than at least one other of said plurality of openings.

4. The apparatus of claim 2 wherein at least one of said plurality of openings has a different radius than at least one other of said plurality of openings.

5. The apparatus of claim 2 wherein at least one of said plurality of openings has a different radius and a different length than at least one other of said plurality of openings.

6. The apparatus of claim 1 wherein said virtual anode has a contoured cross-section.

7. The apparatus of claim 1 wherein said virtual anode has a stepped cross-section.

8. The apparatus of claim 1 further comprising a plating solution, wherein said plating solution flows in said plating bath from said anode to said clamshell through said at least one opening.

9. The apparatus of claim 8 further comprising a power supply for generating an electric current flux between said surface of said substrate and said anode.

10. The apparatus of claim 9 wherein said electric current flux passes through said virtual anode.

11. The apparatus of claim 10 wherein said virtual anode has a plurality of openings therein, a first opening of said plurality of openings having a greater length than a second opening of said plurality of openings, said first opening having a greater electrical resistance to said electric current flux than said second opening.

12. The apparatus of claim 11 wherein a greater percentage of said electric current flux passes through said second opening than through said first opening.

13. The apparatus of claim 10 wherein said virtual anode has a plurality of openings therein, a first opening of said plurality of openings having a greater radius than a second opening of said plurality of openings, said second opening having a greater electrical resistance to said electric current flux than said first opening.

14. The apparatus of claim 13 wherein a greater percentage of said electric current flux passes through said first opening than through said second opening.

15. The apparatus of claim 1 wherein said virtual anode comprises an electrically insulating material.

16. A method of treating a surface of a substrate comprising the steps of:

providing a clamshell, an anode, a virtual anode, and a plating bath containing a plating solution;

mounting said substrate in said clamshell;

placing said clamshell and said substrate in said plating solution; and generating an electric current flux between said surface of said substrate and said anode, wherein said electric current flux passes through said virtual anode, said virtual anode shaping said electric current flux according to a distance between said virtual anode and said substrate.

17. The method of claim 16 wherein said virtual anode has a plurality of openings therein, wherein said electric current flux passes through said plurality of openings and thereby through said virtual anode.

18. The method of claim 17 wherein a first opening of said plurality of openings has a greater cross-sectional area than a second opening of said plurality of openings, a greater percentage of said electric current flux passing through said first opening than through said second opening.

19. The method of claim 18 wherein said first opening and said second opening are cylindrical, the electric current flux through said first opening and said second opening being directly proportional to the square of the radius of said first opening and said second opening.

20. The method of claim 19 further comprising the step of generating a flow of said plating solution through said virtual anode, wherein a greater percentage of said plating solution flow passes through said first opening than through said second opening.

21. The method of claim 20 wherein the plating solution flow through said first opening and said second opening is directly proportional to the cube of the radius of said first opening and said second opening.

22. The method of claim 21 wherein the difference in plating solution flow through said first opening and said second opening is non-linear to the difference in electric current flux through said first opening and said second opening.

23. The method of claim 22 wherein the difference in plating solution flow through said first opening and said second opening is greater than a difference in electric current flux through said first opening and said second opening.

24. A method of treating a surface of a substrate comprising:

providing a clamshell an anode a virtual anode having a plurality of openings therein, a first opening of said plurality of openings having a greater length than a second opening of said plurality of openings, and a plating bath containing a plating solution;

mounting said substrate in said clamshell;

placing said clamshell and said substrate in said plating solution; and generating an electric current flux between said surface of said substrate and said anode, wherein said electric current flux passes through said plurality of openings and thereby through said virtual anode, a greater percentage of said electric current flux passing through said second opening than through said first opening, said virtual anode shaping said electric current flux.

25. The method of claim 24 wherein the electric current flux through said first opening and said second opening is inversely proportional to the length of said first opening and said second opening.

26. The method of claim 24 further comprising the step of generating a flow of said plating solution through said virtual anode, wherein a greater percentage of said plating solution flow passes through said second opening than through said first opening.

27. The method of claim 26 wherein the plating solution flow through said first opening and said second opening is inversely proportional to the length of said first opening and said second opening.

28. The method of claim 26 wherein the difference in plating solution flow through said first opening and said second opening is linear to the difference in electric current flux through said first opening and said second opening.

29. A method of electroplating a metallic layer on a substrate comprising:

immersing said substrate in an electroplating solution;

immersing an anode in said solution;

applying a positive voltage to said anode and a negative voltage to said substrate;

interposing a virtual anode in said electroplating solution between said anode and said substrate, said virtual anode comprising at least a first opening and a second opening; and causing said first opening to have a first width and a first length and said second opening to have a second width and a second length so as to produce a particular thickness profile of said metallic layer, said thickness profile being determined at least in part by said first and second widths and said first and second lengths.

30. The method of claim 29 comprising creating a flow of said electroplating solution through said first and second openings in a direction from said anode to said substrate.

31. An electroplating system for semiconductor wafers comprising:

a power supply having a negative terminal and a positive terminal;

a semiconductor wafer electrically connected to the negative terminal;

a plating bath holding a plating solution;

an anode positioned in the plating solution and electrically connected to the positive terminal;

a nonconductive virtual anode positioned in the plating solution between the anode and the wafer, the virtual anode being in the form of an annulus having a central aperture with a diameter that is less than a diameter of the anode.

32. The electroplating system of claim 31 wherein the diameter of the central aperture is less than a diameter of the wafer.

33. A method of electroplating a layer of metal on a semiconductor wafer comprising:

immersing the wafer in a plating solution;

immersing an anode in the plating solution;

applying a negative voltage to the wafer and applying a positive voltage to the anode; and positioning a virtual anode between the anode and the wafer, the virtual anode being in the form of an annulus having a central aperture with a diameter less than a diameter of the wafer such that the virtual anode functions to limit a flow of current to an edge region of the wafer.

34. The method of claim 33 wherein the diameter of the central aperture of the virtual anode is less than a diameter of the anode.

* * * * *